US009205852B2

(12) United States Patent
Honeck et al.

(10) Patent No.: US 9,205,852 B2
(45) Date of Patent: Dec. 8, 2015

(54) GATE MONITORING SYSTEM

(71) Applicant: Railway Equipment Company, Inc., Plymouth, MN (US)

(72) Inventors: Randall G. Honeck, Maple Grove, MN (US); Craig P. Gabel, Wayzata, MN (US); David K. Fox, Wayzata, MN (US); Greggory C. Phelps, Plymouth, MN (US)

(73) Assignee: Railway Equipment Company, Inc., Plymouth, MN (US)

( * ) Notice: Subject to any disclaimer, the term of this patent is extended or adjusted under 35 U.S.C. 154(b) by 0 days.

(21) Appl. No.: 14/045,675

(22) Filed: Oct. 3, 2013

(65) Prior Publication Data

US 2014/0034785 A1 Feb. 6, 2014

Related U.S. Application Data

(63) Continuation of application No. 13/205,203, filed on Aug. 8, 2011, now Pat. No. 8,550,409, which is a continuation of application No. 12/261,375, filed on Oct. 30, 2008, now Pat. No. 8,066,230.

(60) Provisional application No. 61/001,255, filed on Oct. 30, 2007.

(51) Int. Cl.

| | |
|---|---|
| ***B61L 29/00*** | (2006.01) |
| ***B61L 29/08*** | (2006.01) |
| ***B61L 29/30*** | (2006.01) |

(52) U.S. Cl.

CPC *B61L 29/08* (2013.01); *B61L 29/30* (2013.01)

(58) Field of Classification Search

USPC ..... 246/125, 127, 293, 473.1; 324/244.1, 324/207.11; 73/514.01; 5/125, 127, 293, 5/473.1

See application file for complete search history.

(56) References Cited

U.S. PATENT DOCUMENTS

| | | | | |
|---|---|---|---|---|
| 2,327,366 | A * | 8/1943 | Nampa | 49/28 |
| 4,387,870 | A * | 6/1983 | Matty et al. | 246/122 R |
| 4,679,508 | A * | 7/1987 | Fruehan et al. | 105/341 |
| 5,986,547 | A * | 11/1999 | Korver et al. | 340/500 |
| 6,781,524 | B1 * | 8/2004 | Clark et al. | 340/933 |
| 7,075,427 | B1 * | 7/2006 | Pace et al. | 340/539.22 |
| 7,195,211 | B2 * | 3/2007 | Kande et al. | 246/473.1 |
| 8,066,230 | B2 | 11/2011 | Honeck et al. | |
| 2005/0284987 | A1 * | 12/2005 | Kande et al. | 246/125 |
| 2006/0244595 | A1 * | 11/2006 | Malone et al. | 340/572.1 |
| 2009/0007661 | A1 * | 1/2009 | Nasiri et al. | 73/504.03 |
| 2009/0194642 | A1 * | 8/2009 | Honeck et al. | 246/114 R |
| 2011/0284698 | A1 | 11/2011 | Honeck et al. | |

* cited by examiner

*Primary Examiner* — Jason C Smith

(74) *Attorney, Agent, or Firm* — Merchant & Gould, P.C.

(57) ABSTRACT

A monitoring system and method is provided for monitoring the lighting and the gate arm position at a railroad crossing.

5 Claims, 12 Drawing Sheets

Figure 3: Gate Tip Sensor Flow Chart

Figure 4: Gate Monitor Flow Chart

POSITION SENSOR
U1
dsPIC30F3012
44-QFN
PINS NOT CONNECTED:
3,5,6,7,8,9,10,
11,13,15,21,22,
24,26,27,28,29
U2
MCP
1256
U3
LM2941
ON/OFF
GND
ADJ
IN
OUT
270mA
U4
LIS302ALB
Q1
FMMT
491
Q2
FMMT
491
Q3
FMMT
491
CR1
NRD
4007
D5
CDBA140
D1
D2
D3
D4
D6
3.3V
TVS1
3.5V
LED1
RED
"OK"
NC
NC/NC
WIRE 1
WIRE 2
WIRE 3
CONNECTION
3.3-10.5V
J1
J2
WT MCLR
GR PGD
YW PGC
RD
BK
R1
5.6Ω
5W/5%
R2
3W/5%
51Ω
N.C.
R3
750Ω
R4
1.25K
R5 100K
R6 100K
R7
100K
R8
22.1K
R9
20Ω
3W/5%
R10
4.7Ω
1W/1%
R11
46.4Ω
0.5W/1%
R12
1.25K
R13
750Ω
R14
4.75K
R15
180Ω
R16
100K
R17
13.7K
R18
1.25K
R19
750Ω
C1
100/35V
C2
.1/50V
C3
33/10V
C4
1/16V
C5
1/16V
C6
.01/50V
C7
33/10V
C8
22/16V
C9
1/50V
C10
.1/50V
C11
.01/50V
C12
.01/50V
C13
.01/50V
C14
.1/50V
C15
1/50V
C16
10/25V
NC

GATE MONITOR
GATE IS DOWN
GATE IS UP
GATE LIGHTS OK
TEACH
INPUT +
INPUT -
OUTPUT +
OUTPUT -
SWITCHED INPUT OUTPUT (GREEN)
PINS NOT CONNECTED:
3,5,6,7,8,9,10,
11,13,15,21,22,
24,26,27,28,29

GATE MONITOR

GATE MONITOR

GATE MONITORING SYSTEM

CROSS REFERENCE TO RELATED APPLICATIONS

This application is a continuation of U.S. application Ser. No. 13/205,203 filed Aug. 8, 2011, which is a continuation of U.S. application Ser. No. 12/261,375 filed Oct. 30, 2008 and issued as U.S. Pat. No. 8,066,230 on Nov. 29, 2011, which claims the benefit of U.S. Provisional Patent Application Ser. No. 61/001,255 filed on Oct. 30, 2007, the disclosures of which are hereby incorporated by reference in their entireties.

TECHNICAL FIELD OF THE INVENTION

A monitoring system and method designed to be used in conjunction with a railroad crossing gate arm and light system.

BACKGROUND

Railroad crossing gates are in widespread use and are provided with long crossing arms for traffic barriers. The crossing arms are normally upright and are swung to a lowered, horizontal position when an approaching train is detected. The crossing arms of railroad crossing gates are provided with various signal lights that are secured to the crossing arm. Conventionally, three signal lights are used. A first light is disposed at the free end of the crossing arm. The remaining two lights are generally spaced along the crossing arm. It is conventional that the lights be incorporated into an electrical circuit such that the light at the free end is constantly illuminated when the crossing arm is in its horizontal position. The remaining signal lights are disposed in the electrical circuit such that they are flashing with the two lights alternately flashing off and on.

The environments in which railroad crossing gates are employed are numerous. For example, the crossing gates may be placed adjacent to railroad lines in urban areas where they span streets of widely varying widths. It can be difficult to timely identify malfunctioning crossing arms. There is a need in the art for a monitoring system that can alert an operator when the arm or lights thereon are malfunctioning.

SUMMARY

A monitoring system and method is provided for monitoring the lighting and the gate arm position at a railroad crossing.

DETAILED DESCRIPTION

The present disclosure relates to a system for monitoring the position of a gate arm to determine if portions of the arm have broken off or if the arm is in the correct orientation. The system includes a sensor that is located at the distal portion of the gate arm. The distal portion is the most vulnerable end of the gate arm (when portions of the arm are broken off, the broken off portions typically include the distal end). When the distal potion of the gate arm is in the correct orientation, it is likely that the remaining portions of the arm are also in the correct orientation.

The sensor of the present disclosure is configured to receive power from existing wires on the gate arm which are used to power the lights on the gate arm. The position sensor receives power even when the lights on the gate arm are off (e.g., when the arm is in the inactive, generally vertical, position). In embodiments where the lights are LED-type lights, a certain amount of power can be directed through the lights without having the lights actually light up. This relatively small amount of power is enough to power the position sensor, thereby avoiding the need to have separate wires running along the gate arm to position the sensor.

Figure 2:
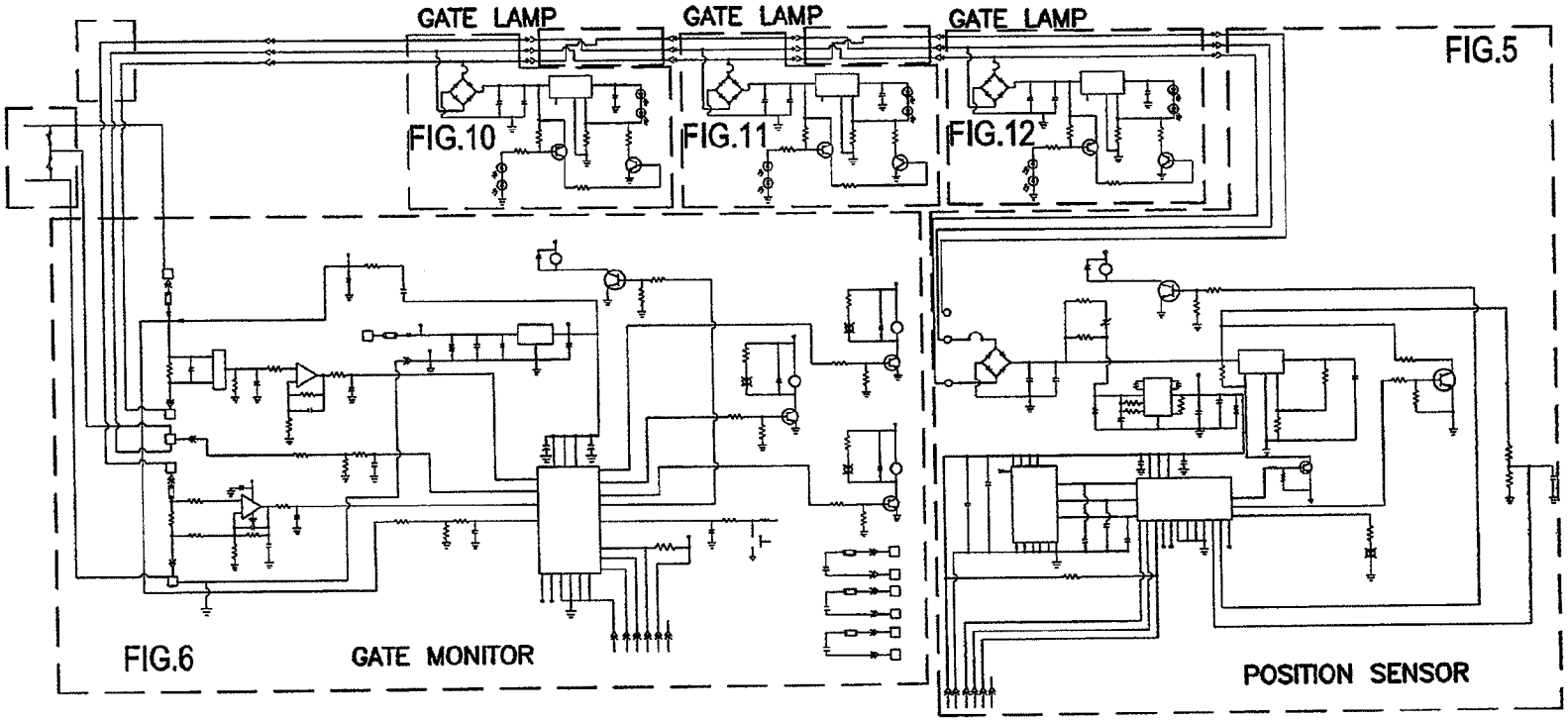
FIG. 2 is a circuit diagram of the monitoring system of FIG. 1.
Figure 5:
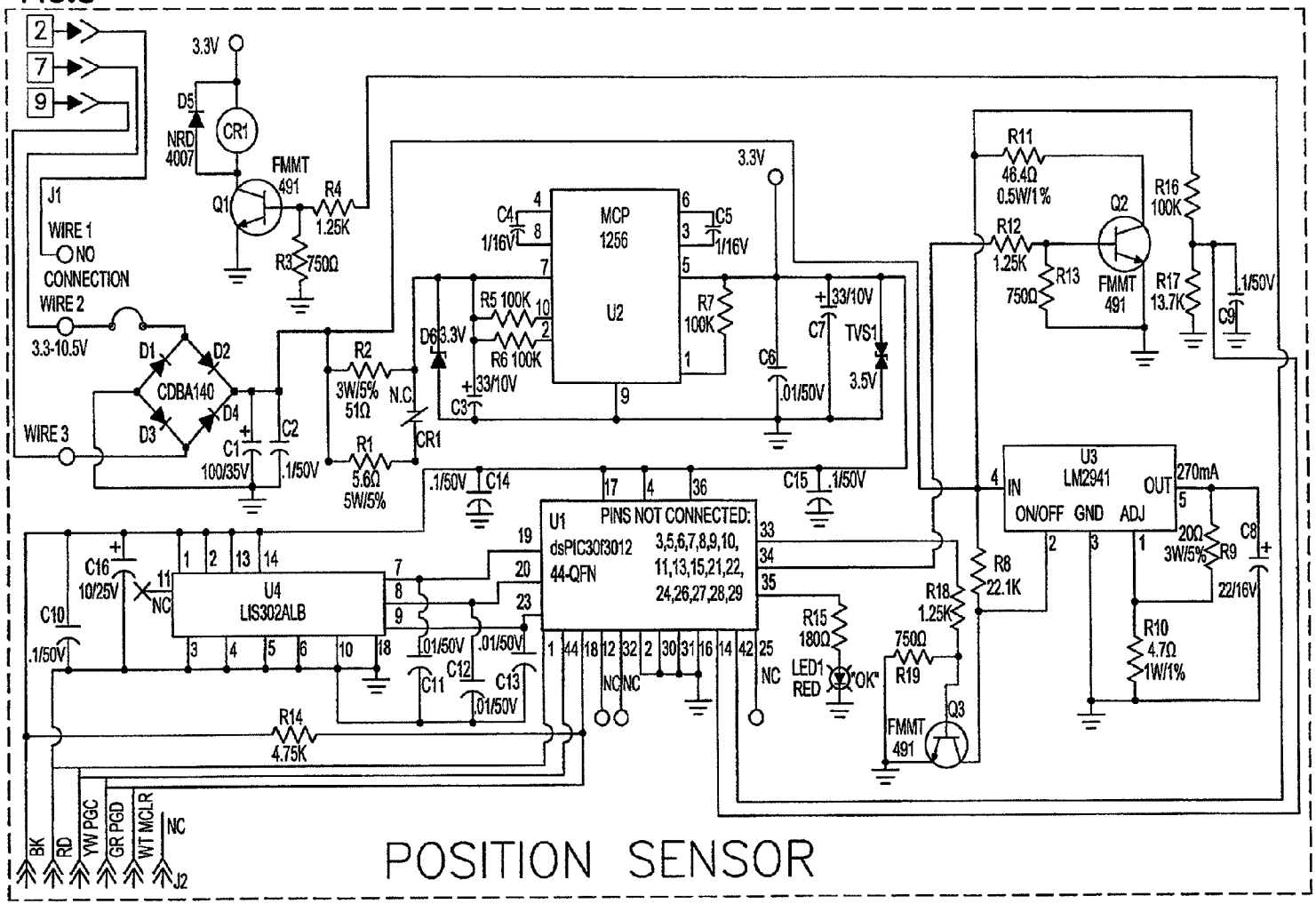
FIG. 5 is an enlarged portion of FIG. 2.
Figures 6, 7, 8:
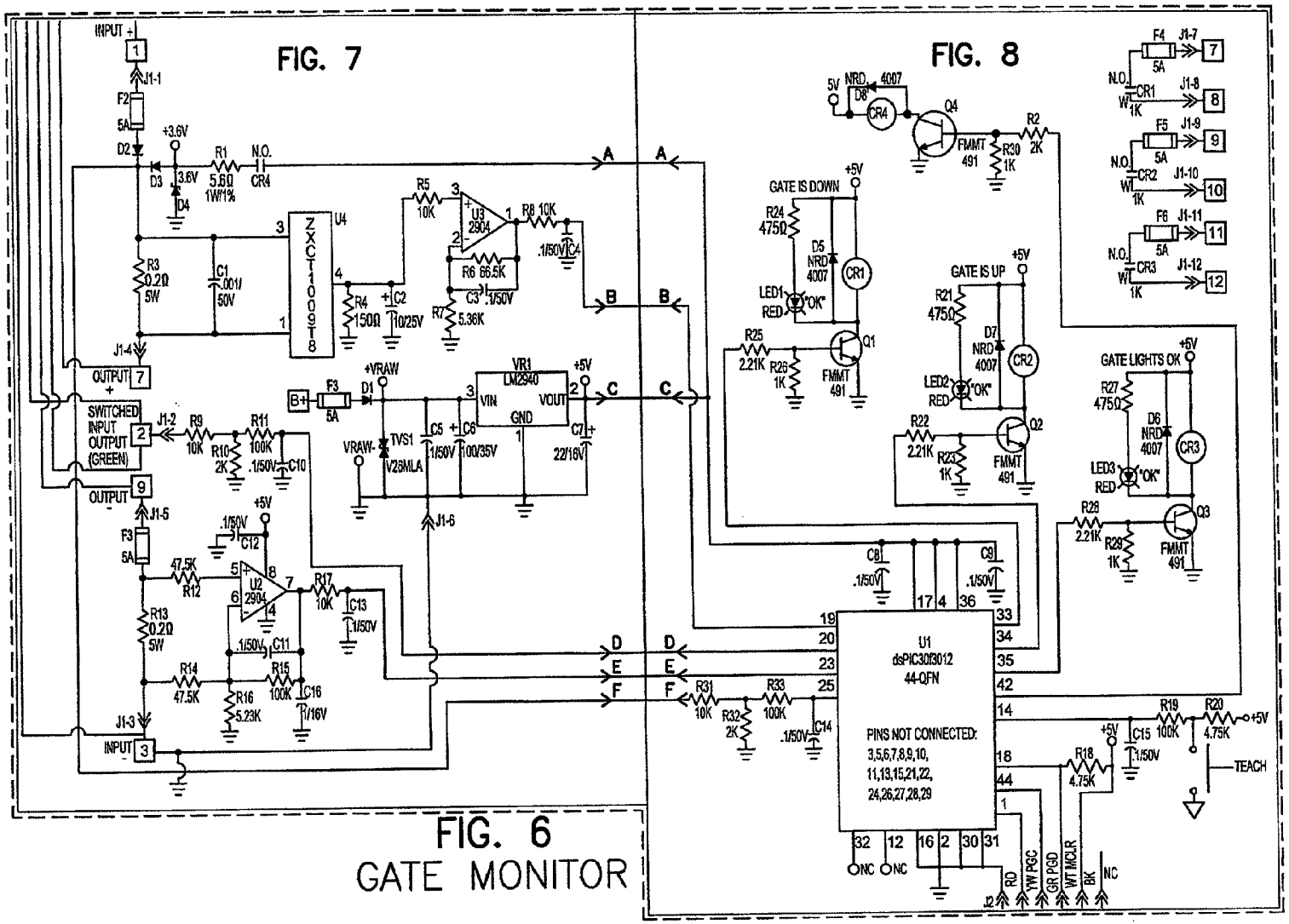
FIG. 6 is an enlarged portion of FIG. 2.
FIGS. 7 and 8 are enlarged portions of FIG. 6.
Figure 7:
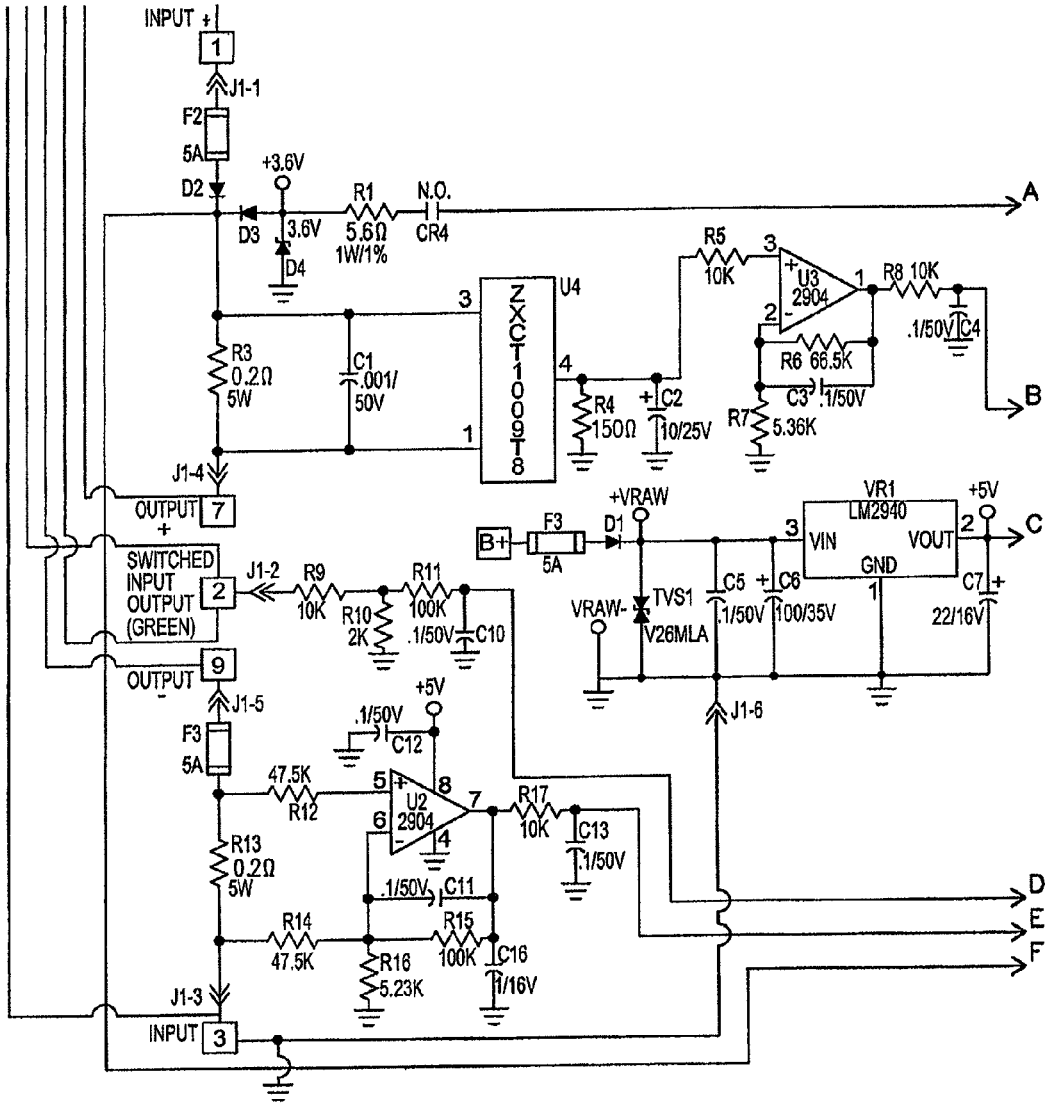
Figure 8:
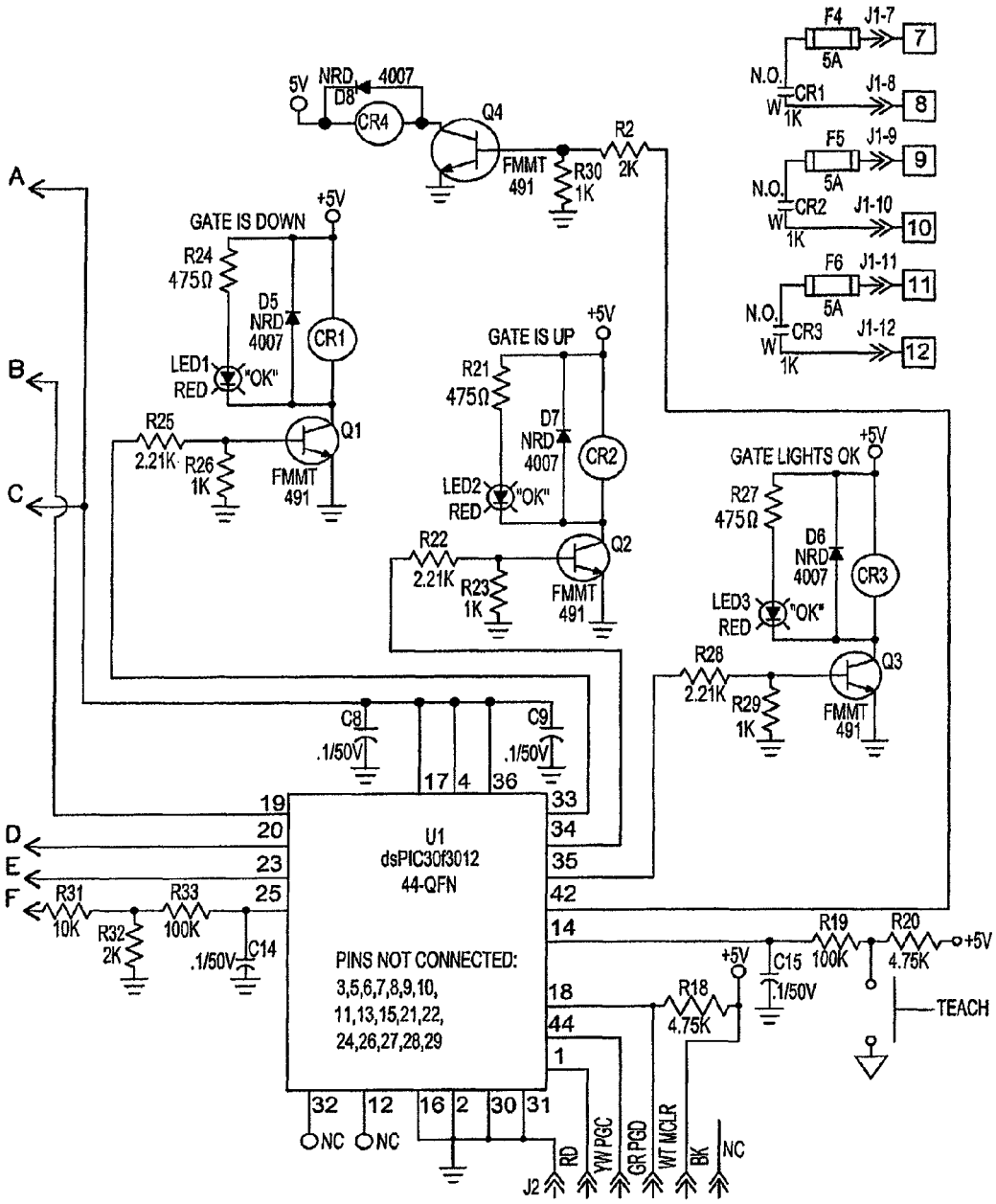
Figure 9:
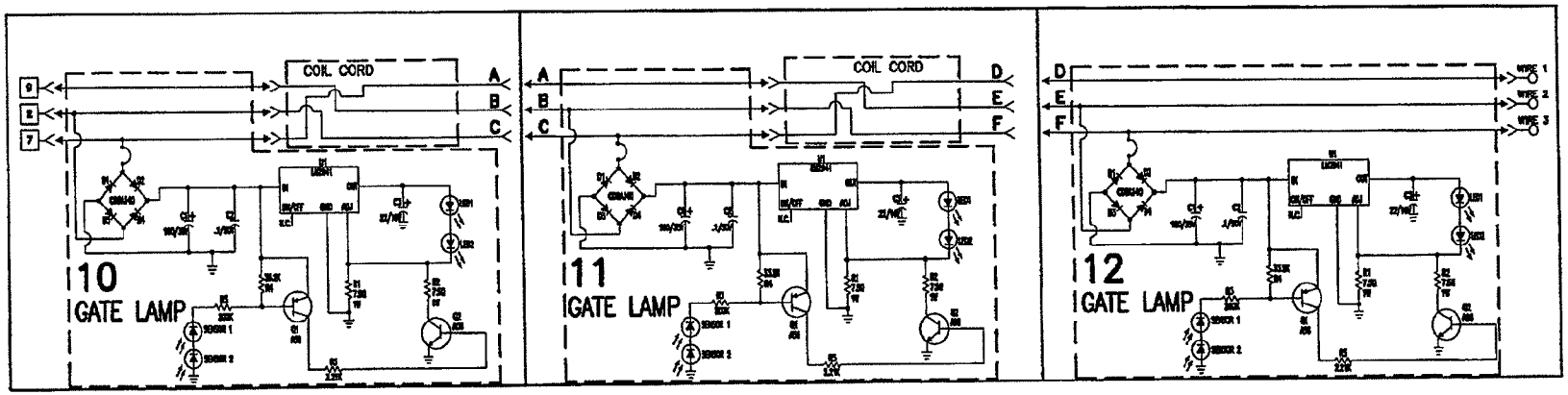
FIG. 9 is an enlarged portion of FIG. 2.
Figure 10:
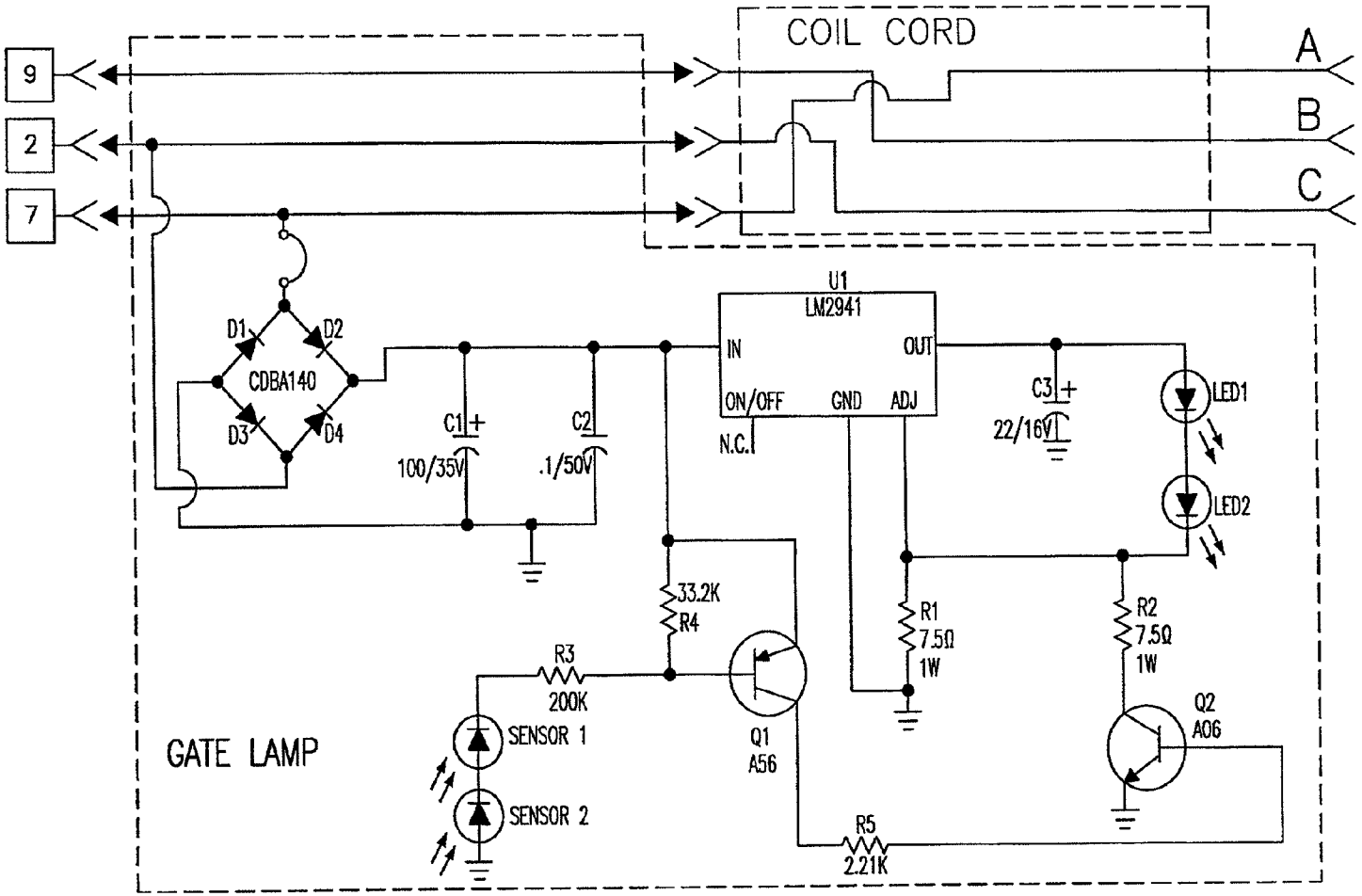
FIGS. 10-12 are enlarged portions of FIG. 9.
Figure 11:
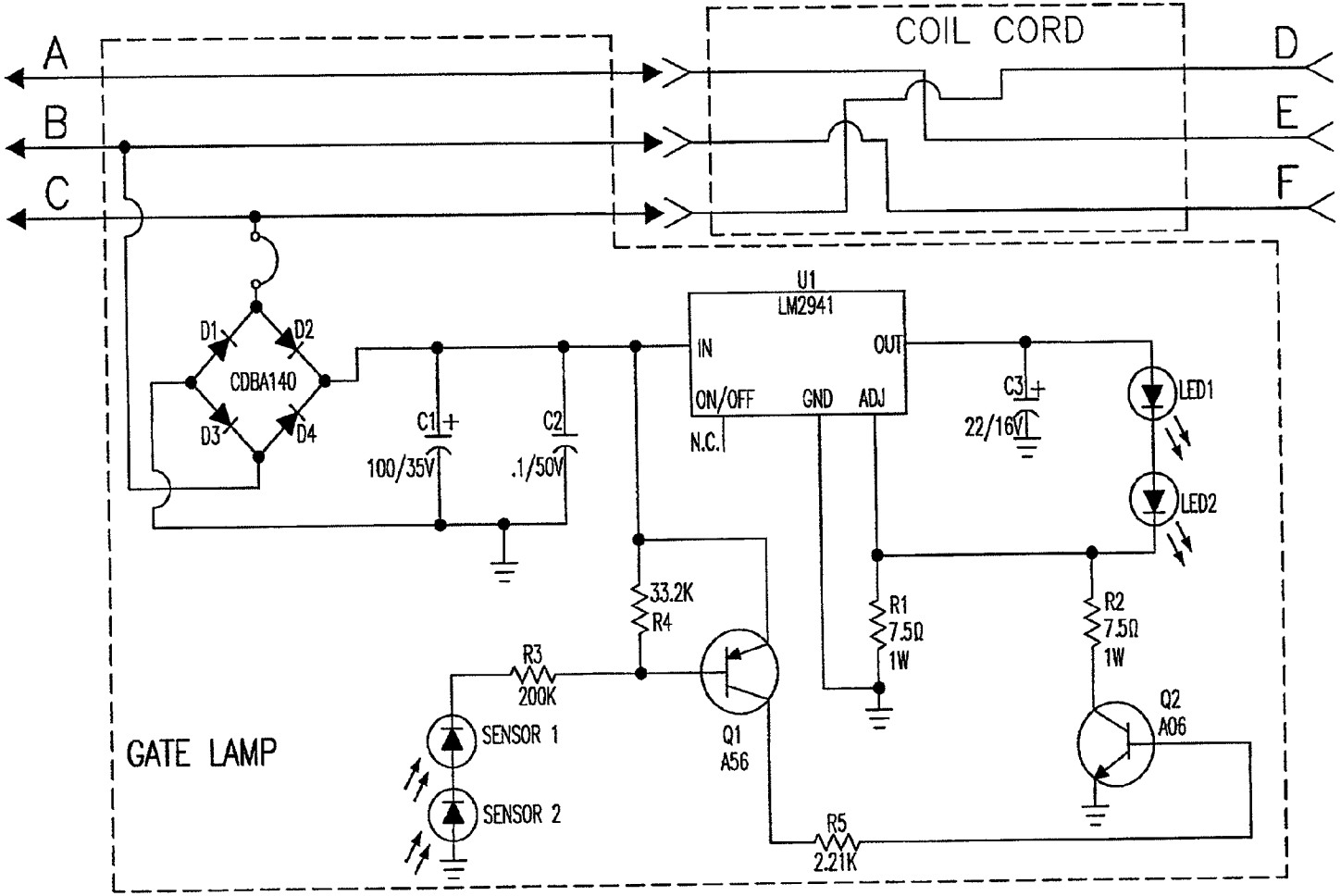
Figure 12:
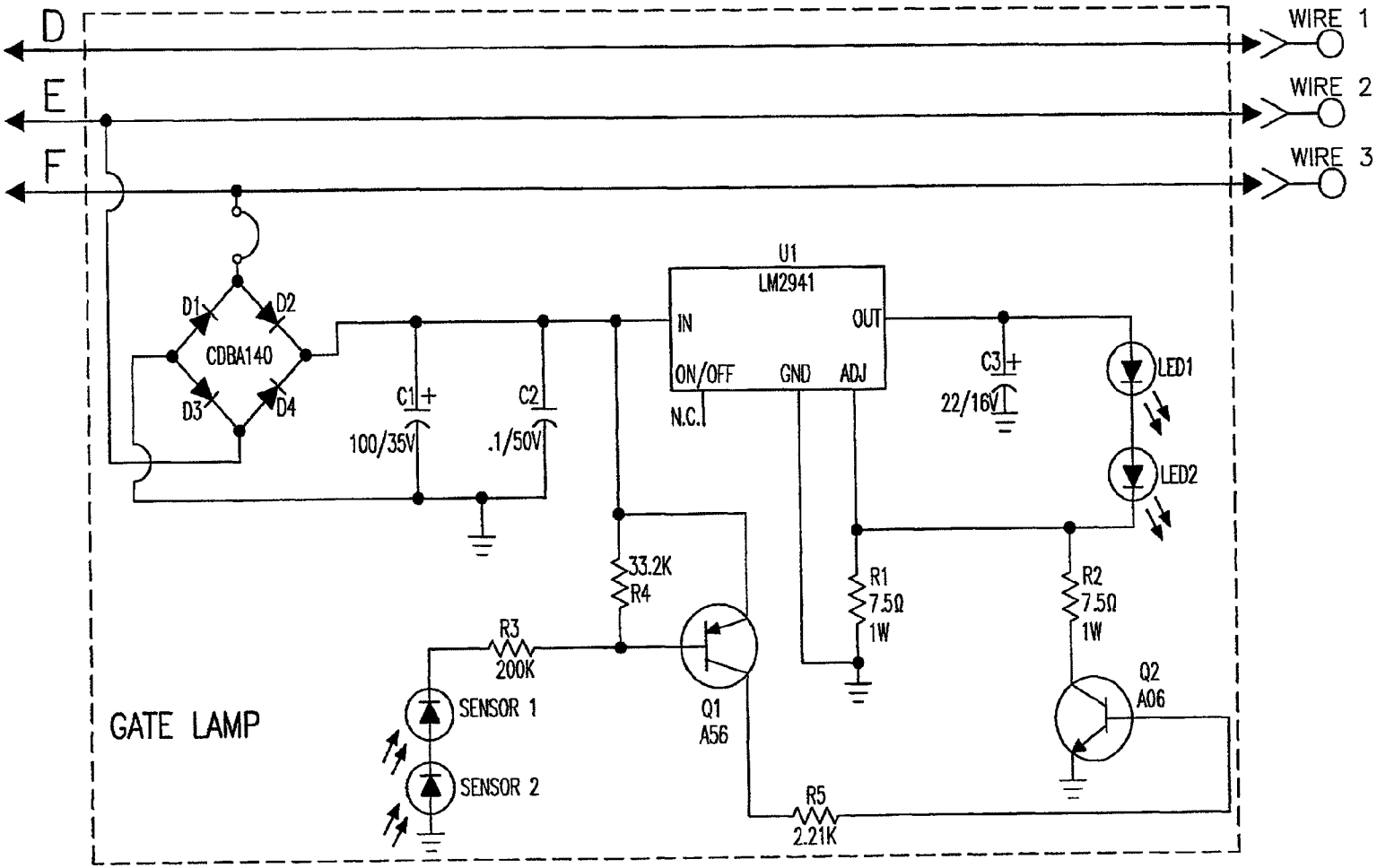

Referring to FIGS. 2 and 5, the position sensor of the depicted embodiment includes a sensor unit U4 (e.g., a 3-axis G-sensor (accelerometer) available from ST Micro) that receives power from a charge pump U2 that amplifies the low level electric power received from the position sensor from the light wires. The sensor unit U4 sends a signal to the microprocessor unit U5 which sends a triggering signal to a current pulse generator when certain conditions are met. For example, in some embodiments when the gate arm is in a raised position and when the gate arm is in the lowered position, current pulses are sent (i.e., when the gate arm is between the raised position and lowered position, current pulses are not sent). The frequency of the pulses is different depending on whether the gate arm is raised or lowered. The current pulse generator sends a current pulse down the light wires to the main microprocessor unit that is located in the base of the gate arm. In some embodiments, the main microprocessor unit is wired to a bungalow located near the base of the gate arm unit. The bungalow is configured to receive and transmit the information to the controller (end user).

According to one embodiment of the present disclosure a crossing arm system is provided. The system includes: a crossing arm including a first end portion and a second end portion; a base connected to the first end portion of the crossing arm, wherein the base is configured to drive the first end portion, thereby causing the crossing arm to move from a raised position to a lowered position; a plurality of lights connected on the crossing arm, wherein the lights are configured to be not illuminated when the crossing arm is in the raised position; an arm position sensor connected to the second end portion of the crossing arm, wherein the arm position sensor is electrically connected to at least one of the lights to receive electrical power therefrom; wherein the arm position sensor includes a charge pump configured to magnify the electrical energy received from the light to a level that is sufficient to power the arm position sensor even when the light is not illuminated. The arm position sensor can be configured to send a signal (e.g., a current pulse) to the controller in the base that corresponds to the position of the second end of the crossing arm. For example, a current pulse of a first frequency can be sent when the arm position sensor senses that the arm is in the raised position, and a current pulse of a second frequency can be sent when the arm position sensor senses that the arm is in the lowered position and when the crossing arm is between positions, neither of the first or second frequency are sent. In some embodiments the arm position sensor includes an electrical component that generates the current pulse, sensing unit, and a microprocessor that is configured to calibrate the sensing unit, receive signals from the sensing unit and trigger the electrical component to generate current pulses. According to some embodiments the crossing arm system includes non-dedicated wires that extend between the position sensor and the base.

According to some embodiments a position sensing unit is provided that includes signals received from the multi-axis accelerometer. The charge pump can be configured to receive electricity from wires connected to LED lights that are not illuminated. The above-referenced components of the position sensing unit can be housed in a weatherproof housing and mounted to a crossing gate arm. The microprocessor can be configured to trigger the pulse generator to send a pulse at a first frequency when the multi-axis accelerometer indicates that the gate arm is in the raised position, and a second frequency when the multi-axis accelerometer indicates that the gate arm is in the lowered position. In some embodiments the lowered position corresponds to the gate arm being in a first angle range, and the raised position corresponds to the gate arm being in a second angle range. A position sensing unit is also provided. The unit includes a charge pump; a multi-axis accelerometer electrically connected to the charge pump; a microprocessor connected to the multi-axis accelerometer; a pulse generator electrically connected to the microprocessor; wherein the microprocessor is configured to direct the pulse generator to send current pulses based on the signals received from the sensor unit.

Figure 1:
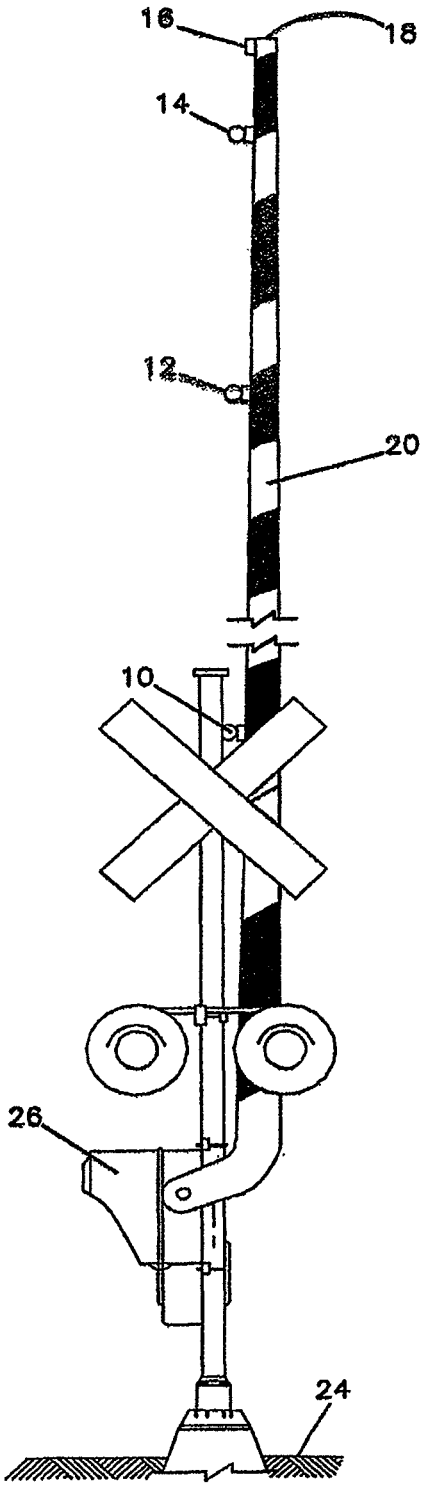
FIG. 1 is a schematic diagram of the monitoring system according to one embodiment of the present disclosure.

Referring to FIGS. 1-2, the lamps 10, 12 and 14 can be any type of device that generates light. In the depicted embodiment the lamps 10, 12 and 14 are EZ Gate® LED Lamps with Light Out Detection (LOD). They are railroad crossing gate arm 20 lamps that adjust their operating current based on whether or not the lamp illuminates. The purpose of such lamps 10, 12 and 14 is to both provide light at the gate arm 20 and to provide electrical feedback of their state of illumination. It should be understood that though in the depicted embodiment the lamps are EZ Gate® LED lamps with Light Out Detection, the lamps 10, 12 and 14 could alternatively be any other type of light emitting diodes (LED) or a non-LED lamp such as an ordinary incandescent bulb. In addition, it should be appreciated that in an alternative embodiment, any suitable number of lamps 10, 12 and 14 may be used.

The arm position sensor 16 in the depicted embodiment is an EZ Gate® Arm Positioning Sensor, which is mounted to the distal end 18 of the crossing gate arm 20. It should be appreciated that in alternative embodiments various other types of sensor configurations for monitoring the position of the crossing gate 20 are possible.

The Railway Equipment Co. EZ Gate® Arm Position Sensor is an electronic device that connects to a railroad crossing signal gate arm tip light which introduces a known electrical load to the crossing signal gate arm lighting circuit based on position of the crossing gate arm relative to level grade. The purpose of this device is primarily to provide feedback of the crossing signal gate arm position relative to level to determine if the gate has been damaged or is faulty in its operation. This is achieved by simply connecting the device to the last gate lamp on the gate arm. No additional wires or fasteners are required.

The arm position sensor 16 is an electronic device that introduces a known pulsating electrical load to the crossing signal gate arm lighting circuit 22. The known electrical pulsating load varies based on the position of the crossing gate arm 20 relative to the horizontal 24, i.e., level grade. In one embodiment of the invention the position sensor 16 is configured to introduce a known pulsating current load of 200 mA when the position sensor 16 detects that the gate arm 20 is within +\−15 degrees of the horizontal 24 in the vertical plane and +\−25 degrees in the horizontal plane to be known as the "down position". The position sensor 16 is configured to introduce a known pulsating current load of 50 mA when the position sensor 16 detects that the gate arm 20 is within +70 to +90 degrees of the horizontal 24 in the vertical plane and +\−25 degrees in the horizontal plane, to be known as the "up position". When the gate arm 20 is positioned in the "up position", and the gate lamps 10, 12 and 14 are not illuminated, the monitoring unit 26 will provide 3.3V to the arm position sensor 16, for a short period of time every 5 minutes. This low power will keep the gate lamps 10, 12 and 14 off, while providing power to the arm position sensor 16, allowing the monitoring unit 26 to determine if gate arm 20 is positioned correctly.

Figure 3:
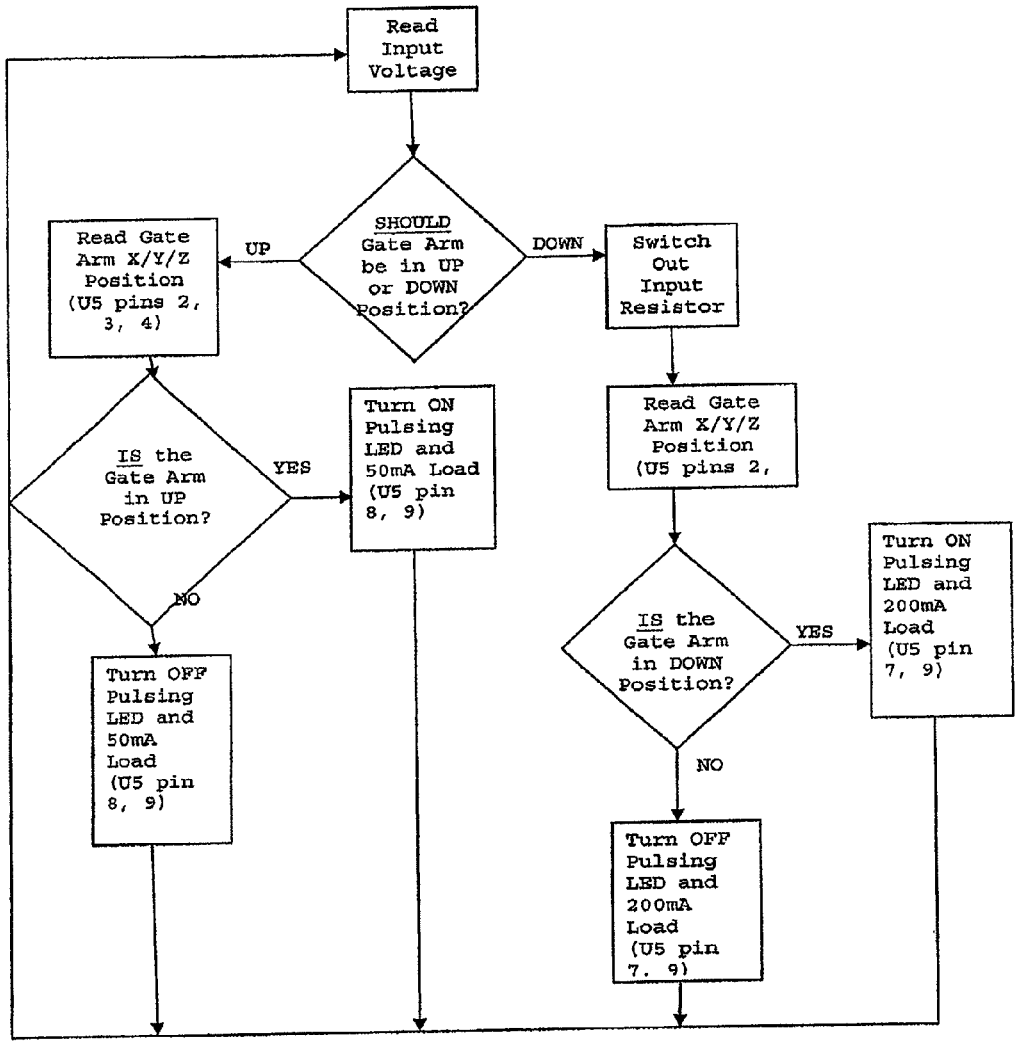
FIG. 3 is a gate tip sensor flow chart.

Referring to FIG. 3, if the crossing gate arm is not positioned within the acceptable range relative to level grade, then no load is placed on the crossing signal gate lamp circuit and is also detectable by current sensing devices like the Railway Equipment Company EZ Gate® Monitor to provide indication that the crossing gate arm is not in the desired position.

Electrical Specifications:

Operating voltage is 2.8 to 14 volts DC.

Operating current is between 90 mA and 350 mA.

Make position is +/−15 degrees from level grade (gate arm down) or +70 to +90 degrees from level grade (gate arm up).

Perpendicular to gate movement (side to side) is +/−25 degrees from level grade.

According to one embodiment of the present disclosure the position sensor power is received from the tip light. On one power line, a fuse trace is provided to protect down line components from shorted or other malfunctions in position sensor. A bridge rectifier is provided for bidirectional power. C1 and C2 are provided for filtering and protection of down line components. R1 is for limited current to D6 3.3V zener diode. Normally closed contact CR1 remains closed in low voltage mode (up position). CR1 opens when voltage is above 8V removing R1 from circuit. R2 is then the dropping resistor for D6. D6 limits the voltage to U2 boost voltage regulator. U2 supplies a constant 3.3V output with input voltage as low as 1.8V. U5 is the microcontroller (see tip sensor flow chart for operation). Capacitors C14 and C15 remove noise from the power supply to U5. Wires labeled BK, RD, YW PGC, GR PGD, and WT MCLR, as well as resistor R14 are reserved for programming purposes. U4 is a 3 axis accelerometer which outputs 3 analog voltage values depicting at what angle gravity (or any other acceleration) is acting upon U4. Capacitors C11, C12, and C13 remove noise from the analog voltages outputted from U4, and C10 removes noise from its power supply. Resistor R19 is a pull-down resistor and R18 is a current limiting resistor. When U5 sets pin 7 to high, transistor U6 provides a path to ground, allowing U3 to turn on. U3 is a voltage regulator, that, when used in conjunction with resistors R9 and R10, will provide a load current of 200 mA. Capacitor C8 is used as a filter to remove oscillations from the load current produced by U3. R8 is a pull-up resistor, keeping U3 off until U6 provides a path to ground. Resistor R13 is a pull-down resistor and R12 is a current limiting resistor. When U5 sets pin 8 to high, transistor U7 provides a path to ground for a load current to travel through resistor R11. R15 is a current limiting resistor used to control the brightness and lifespan of LED1. Resistors R16 and R17 create a voltage drop for U5 to monitor the input voltage to the Position Sensor. C9 removes noise from the R16/R17 voltage drop to U5. Resistor R3 is a pull-down resistor and R4 is a current limiting resistor. When U5 sets pin 10 to high, transistor U1 provides a path to ground through coil CR1. When coil CR1 is energized, the normally closed contact CR1 will open. D5 is a back emf diode.

Figure 4:
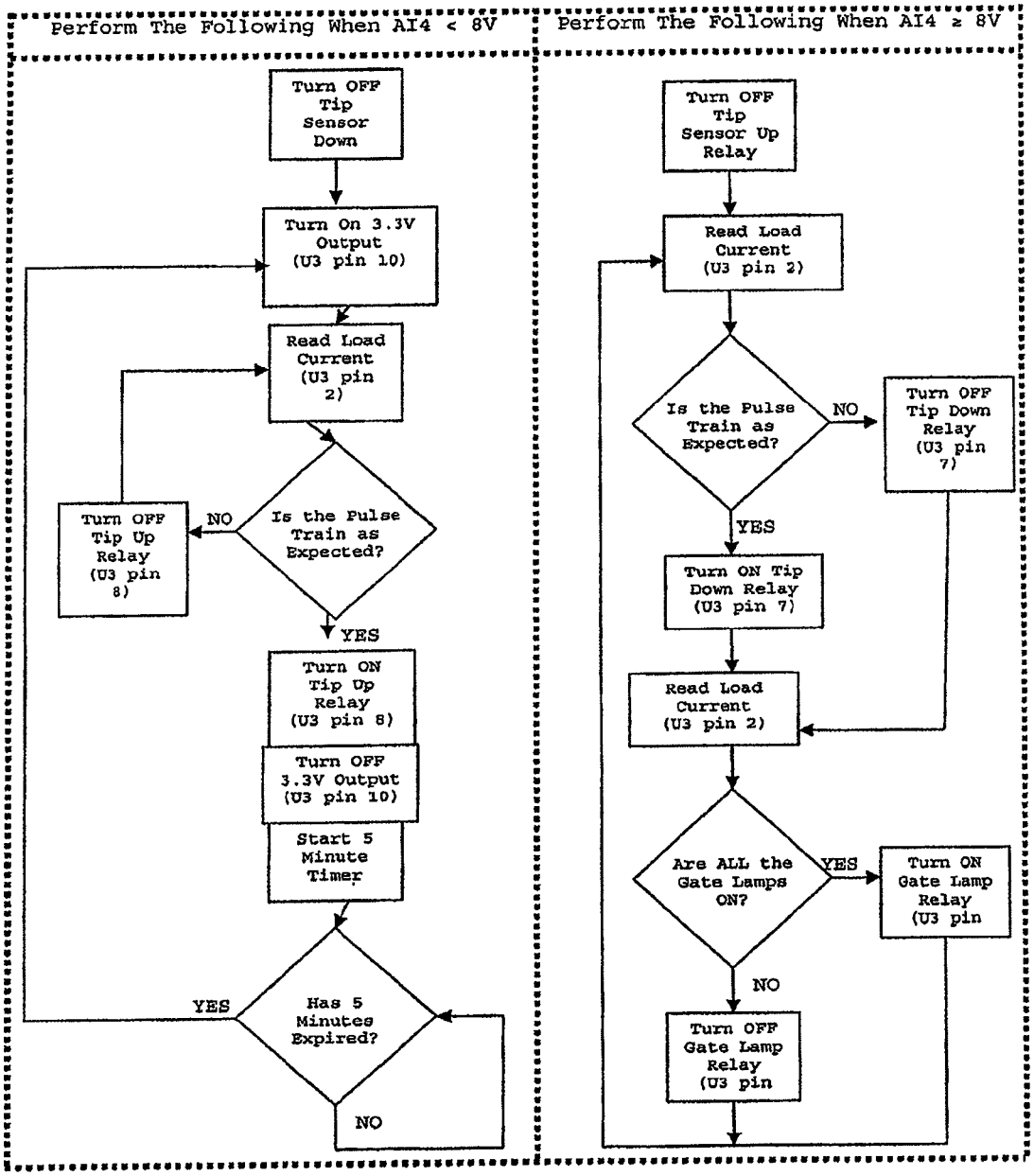
FIG. 4 is a gate monitor flow chart.

Referring to FIG. 4, the Railway Equipment Co. EZ Gate® Monitor is a device that is designed to be used in conjunction with railroad crossing gate arm signal light systems that will monitor all signal gate lamps for proper illumination and correct gate position either the up or down position. The purpose of this device is primarily to indicate failure of elements of the crossing signal gate lighting system and the crossing gate arm position relative to level grade or up position.

The EZ Gate® Monitor would generally mount in the gate machine electrical enclosure and is electrically connected in series with the crossing signal gate lamp system. The EZ Gate® Monitor provides "line" or input electrical terminals and "load" or output electrical terminals and senses the operating current of each of the gate lamps. The EZ Gate® Monitor also monitors the additional pulse current of a crossing gate arm position sensor, if present, to determine proper gate position. When all operating conditions are correct, a control relay within the EZ Gate® Monitor energizes and B+ voltage contacts will transition. This can be used in the gate crossing circuitry to provide feedback of light out, gate arm in down ok position, and gate arm in up ok position. If the measured current of the crossing gate arm lamps and optional arm position sensor fall below a minimum predetermined level, the output relay will not energize and the corresponding contacts will not transition, thus indicating the fault has been detected.

An LED is provided for all 3 conditions on the EZ Gate® Monitor device. The device illuminates when all gate crossing arm lights are illuminated and the gate is in the correct horizontal position, or if gate is in up and lamps are off if equipped with a gate arm position switch.

Electrical Specifications:

Operating voltage is 11 to 16 volts.

Operating current 50 ma. Constant through voltage range.

Output contact 5 amps@12 VDC.

Three fuses are provided to protect the EZ Gate® Monitor from load-connected faults.

EZ Gate® Monitor power is received from a switch machine and connected to B+ and B− pins. This power is used to supply power to the three outputs and to power the internal 5V power supply. The B+ is also fused F1 and a diode D1 is provided to prevent feedback. Gate lamp plus power goes to pin 1, minus goes to pin 3, and switched goes to pin 2. Pin 1 connects to fuse 2; this fuse protects R3 and D2 from short circuit. D2 is for reverse polarity protection. R3 current sense resistor develops voltage to be use by high side current monitor U1. C1 is an input filter for U1. R4 is a gain resistor used by U1. C2 is a filter capacitor. U2 is a gain amp determined by R6 and R7. R8 and C4 is an RC filter going in analog input channel of U3.

The minus side of the gate monitor operates as follows starting at terminal 3 (common). Terminal 3 connects R13 current sense resistor develops voltage to be used by minus side current sense circuit, to fuse 3 which protects R13 from short circuit. R12 is a sampling resistor used by gain amp U2. C12 is a filter capacitor. U2 is a gain amp determined by voltage divider R14 and R16. R17 and C13 is an RC filter going in to analog input channel of U3. U3 enables pin 7 to go high, turning on transistor Q1. R26 is a pull down resistor and R25 is a limiting resistor. When Q1 is on it enables output relay CR1 to activate. D5 is back emf diode. R24 is a limiting resistor for LED 2 (GATE IS DOWN). This closes contact CR1 which allows B+ voltage on pin 4. U3 enables pin 8 to go high, turning on transistor Q2. R23 is a pull down resistor and R22 is a limiting resistor. When Q2 is on it enables output relay CR2 to activate. D7 is back emf diode. R21 is a limiting resistor for LED 1 (GATE IS UP). This closes contact CR2 which allows B+ voltage on pin 5.

U3 enables pin 9 to go high, turning on transistor Q3. R29 is a pull down resistor and R28 is a limiting resistor. When Q3 is on it enables output relay CR3 to activate. D6 is back emf diode. R27 is a limiting resistor for LED 3 (GATE LIGHTS OK). This closes contact CR3 which allows B+ voltage on pin 6.

U3 enables pin 10 to go high, turning on transistor Q4. R30 is a pull down resistor and R2 is a limiting resistor. When Q4 is on it enables output relay CR4 to activate. D8 is back emf diode. This closes contact CR4 and allows +5v to limiting resistor R1. R1 connects to zener diode D4 this creates a fixed 3.8 volts that feeds into D3 back feed diode. This circuit provides the tip sensor voltage when gate is in up position.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of monitoring a crossing arm comprising:

providing a crossing arm including a first end portion and a second end portion and a length therebetween, wherein the second end portion is positioned above the first end portion when the cross arm is in a raised position, wherein the second end portion is lowered when the arm is in a lowered position;

mounting a position sensor to the second end portion of the crossing arm;

delivering electrical power to the position sensor through one or more wires that also power LED lights on the crossing arm, wherein the electrical power is delivered at a voltage that is insufficient to cause the LED lights to illuminate; and magnifying the voltage of the delivered electrical power to a level that is sufficient to periodically power the position sensor.

2. The method of claim 1, wherein the position sensor is configured to emit a signal at a first frequency when the arm is in the raised position and emit a signal at a second frequency when the arm is in the lowered position.

3. The method of claim 2, wherein the position sensor is configured to only emit signals when the crossing arm is in the raised and lowered positions.

4. The method of claim 3, wherein the lowered position corresponds to a first range in the angle of the crossing arm relative to the horizontal, and the raised position corresponds to a second range in the angle of the crossing arm relative to the horizontal.

5. A crossing arm comprising:

a first end portion and a second end portion and a length therebetween, wherein the second end portion is positioned above the first end portion when the cross arm is in a raised position, wherein the second end portion is lowered when the arm is in a lowered position;

a position sensor mounted to the second end portion of the crossing arm;

at least one wire configured to power LED lights on the crossing arm that are also configured to delivering electrical power to the position sensor, wherein the electrical power is delivered at a voltage that is insufficient to cause the LED lights to illuminate; and a device mounted to the second end portion of the crossing arm configured to magnify the voltage of the delivered electrical power to a level that is sufficient to periodically power the position sensor.

* * * * *